US009511979B2

(12) United States Patent
Maruyama

(10) Patent No.: US 9,511,979 B2
(45) Date of Patent: Dec. 6, 2016

(54) UNDERSLUNG ELEVATOR

(71) Applicant: MITSUBISHI ELECTRIC CORPORATION, Chiyoda-ku (JP)

(72) Inventor: Naoyuki Maruyama, Chiyoda-ku (JP)

(73) Assignee: MITSUBISHI ELECTRIC CORPORATION, Chiyoda-ku (JP)

( * ) Notice: Subject to any disclaimer, the term of this patent is extended or adjusted under 35 U.S.C. 154(b) by 0 days.

(21) Appl. No.: 14/904,882

(22) PCT Filed: Aug. 2, 2013

(86) PCT No.: PCT/JP2013/071013
§ 371 (c)(1),
(2) Date: Jan. 13, 2016

(87) PCT Pub. No.: WO2015/015637
PCT Pub. Date: Feb. 5, 2015

(65) Prior Publication Data

US 2016/0159615 A1 Jun. 9, 2016

(51) Int. Cl.
*B66B 11/02* (2006.01)
*B66B 15/02* (2006.01)

(52) U.S. Cl.
CPC ..... *B66B 11/0266* (2013.01); *B66B 11/0206* (2013.01); *B66B 15/02* (2013.01)

(58) Field of Classification Search
CPC ... B66B 11/0266; B66B 11/0206; B66B 15/02
(Continued)

(56) References Cited

U.S. PATENT DOCUMENTS 3,101,130 A * 8/1963 Bianca ..... B66B 11/08 187/244
6,443,266 B2 * 9/2002 Murakami ..... B66B 11/08 187/401
(Continued)

FOREIGN PATENT DOCUMENTS

JP 52-93162 7/1977
JP 62-096291 A 5/1987
(Continued)

OTHER PUBLICATIONS

International Search Report issued Nov. 5, 2013, in PCT/JP2013/071013 filed Aug. 2, 2013.

*Primary Examiner* — Michael Riegelman
(74) *Attorney, Agent, or Firm* — Oblon, McClelland, Maier & Neustadt, L.L.P.

(57) ABSTRACT

An underslung elevator includes: a suspending sheave assembly disposed on a lower portion of a car floor, the suspending sheave assembly being configured such that suspending sheaves are each supported rotatably between two longitudinal end portions of a pair of suspending sheave beams; and rubber vibration isolators disposed between a car frame lower beam and the suspending sheave assembly. The suspending sheaves are supported on the pair of suspending sheave beams such that portions thereof protrude upward beyond the pair of suspending sheave beams, and the rubber vibration isolators are disposed to be positioned vertically above shafts of the suspending sheaves when viewed from an axial direction of each of the suspending sheaves, and to be positioned on opposite sides of each of the suspending sheaves when viewed from vertically above.

12 Claims, 5 Drawing Sheets

(58) Field of Classification Search
USPC ..... 187/266
See application file for complete search history.

(56) References Cited

U.S. PATENT DOCUMENTS

| | | | | |
|---|---|---|---|---|
| 6,722,475 | B2 * | 4/2004 | Miller | B66B 11/02 187/266 |
| 7,543,685 | B2 * | 6/2009 | Ach | B66B 11/004 187/250 |
| 8,528,702 | B2 * | 9/2013 | Maury | B66B 11/0226 187/266 |
| 2004/0173411 | A1 * | 9/2004 | Silberhorn | B66B 11/0226 187/277 |
| 2006/0175140 | A1 * | 8/2006 | Kolb | B66B 11/02 187/266 |
| 2008/0289908 | A1 * | 11/2008 | Murao | B66B 11/0206 187/266 |
| 2011/0056770 | A1 * | 3/2011 | Qiu | B66B 11/02 187/266 |
| 2011/0061978 | A1 * | 3/2011 | Dominguez | B66B 11/0206 187/401 |
| 2016/0068370 | A1 * | 3/2016 | Kyue | B66B 11/0226 187/401 |

FOREIGN PATENT DOCUMENTS

| | | | |
|---|---|---|---|
| JP | 2001-247278 | A | 9/2001 |
| JP | 2003-285983 | A | 10/2003 |
| JP | 4351471 | B2 | 10/2009 |
| JP | 2013-095570 | A | 5/2013 |
| WO | WO 2009/154611 | A1 | 12/2009 |

* cited by examiner

UNDERSLUNG ELEVATOR

TECHNICAL FIELD

The present invention relates to an underslung elevator in which a suspending sheave is disposed on a lower portion of a cage, and particularly relates to a construction for mounting a suspending sheave assembly to the lower portion of the cage.

BACKGROUND ART

In conventional underslung elevators, a suspending sheave assembly that is configured by suspending sheaves so as to be rotatably supported between two longitudinal end portions of a pair of suspending sheave beams is installed on a lower surface of a cage so as to have vibration isolating members interposed (see Patent Literature 1, for example).

CITATION LIST

Patent Literature

Patent Literature 1: International Publication No. WO/2009/154611 (Pamphlet)

SUMMARY OF THE INVENTION

Problem to be Solved by the Invention

In conventional underslung elevators, in order to keep height to a minimum while isolating vibration from the suspending sheave assembly, the vibration isolating members are disposed at positions that are displaced toward a center of the cage from upper portions of the suspending sheaves. Thus, positions at which a suspended load acts on the suspending sheave beams through the shafts of the suspending sheaves and positions at which the suspending sheave beams are supported on the lower surface of the cage are different, giving rise to bending moments in the suspending sheave beams. Because of that, one problem has been that it is necessary to increase the rigidity of the suspending sheave beams by increasing plate thicknesses of the suspending sheave beams, or by increasing height, leading to increased costs and weight in the suspending sheave assembly.

The present invention aims to solve the above problems and an object of the present invention is to provide an underslung elevator that enables reductions in cost and reductions in weight by suppressing the occurrence of bending moments that act on suspending sheave beams while suppressing a protruding height of a suspending sheave assembly from a lower surface of a cage.

Means for Solving the Problem

An underslung elevator according to the present invention includes: a cage; a car frame lower beam that is fixed directly to a lower surface of a car floor of the cage, and that supports the cage; a suspending sheave assembly that is disposed on a lower portion of the car floor, the suspending sheave assembly including: a pair of suspending sheave beams that are disposed so as to face each other so as to be separated; and a pair of suspending sheaves that are each supported rotatably between two longitudinal end portions of the pair of suspending sheave beams; and rubber vibration isolators that are disposed between the car floor and the suspending sheave assembly, or between the car frame lower beam and the suspending sheave assembly, wherein: the pair of suspending sheaves are supported on the pair of suspending sheave beams such that portions thereof protrude upward beyond the pair of suspending sheave beams; and the rubber vibration isolators are disposed so as to be positioned vertically above shafts of the suspending sheaves when viewed from an axial direction of each of the pair of suspending sheaves, and so as to be positioned on opposite sides of each of the pair of suspending sheaves when viewed from vertically above.

Effects of the Invention

According to the present invention, because the rubber vibration isolators are positioned vertically above the shafts of the suspending sheaves when viewed from an axial direction of the shafts, positions at which a load that is suspended by the ropes acts on the suspending sheave beams through the shafts of the suspending sheaves, and positions at which the suspending sheave beams are supported on the car floor or the car frame lower beam, i.e., positions of the rubber vibration isolators, are aligned. Thus, the suspended load acts on the rubber vibration isolators from vertically below, and bending moments that result from the suspended load do not act on the suspending sheave beams. Thus, it is not necessary to increase the rigidity of the suspending sheave beams excessively by increasing the thickness of the suspending sheave beams, or by increasing the height thereof, enabling reductions in cost and reductions in weight of the suspending sheave assembly to be achieved.

The suspending sheaves are supported by the pair of suspending sheave beams such that portions thereof protrude upward beyond the pair of suspending sheave beams, and the rubber vibration isolators are disposed so as to be positioned on opposite sides of the suspending sheaves when viewed from vertically above. Thus, a protruding height of the suspending sheave assembly from the lower surface of the car floor can be reduced.

DESCRIPTION OF EMBODIMENTS

Preferred embodiments of an underslung elevator according to the present invention will now be explained with reference to the drawings.

Embodiment 1

Figure 1:
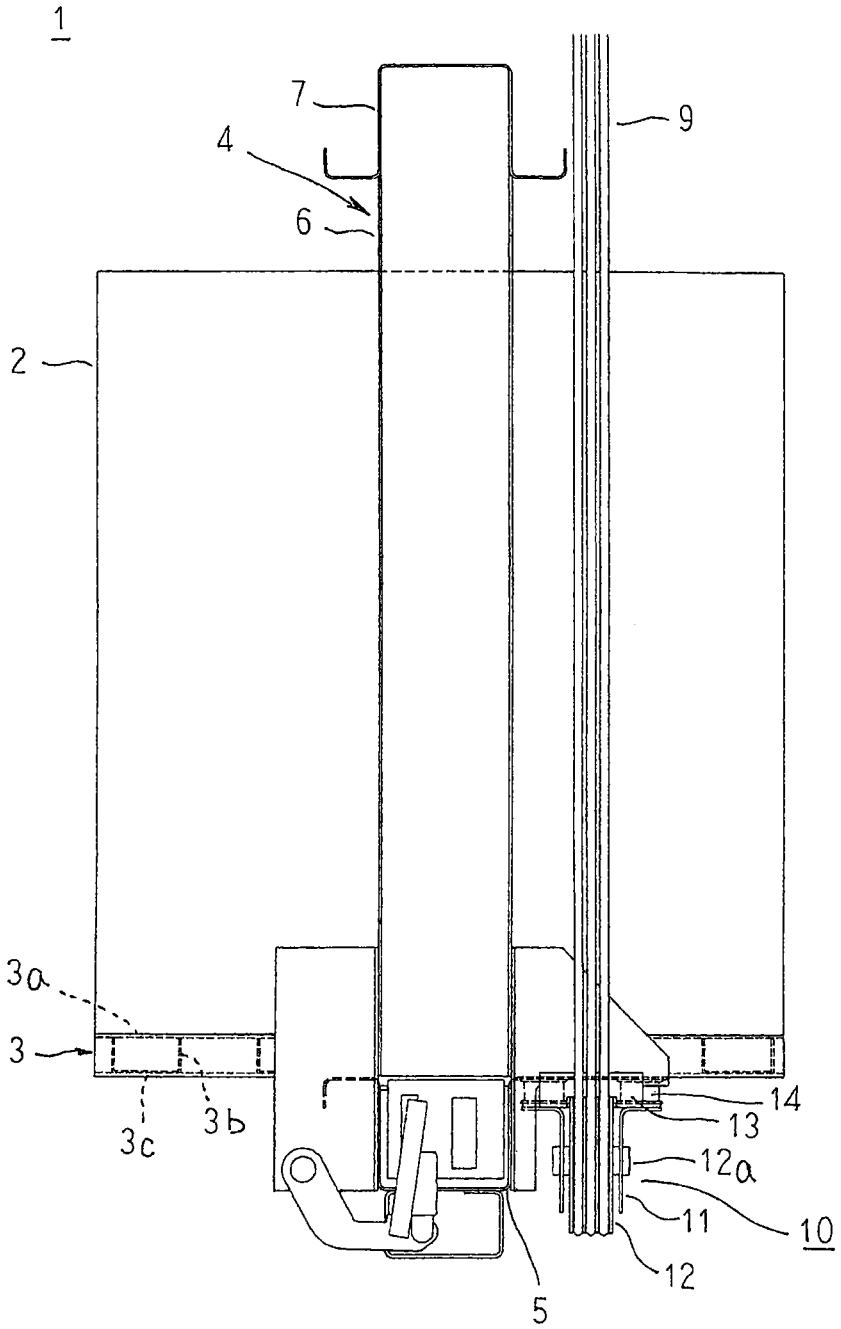
FIG. 1 is a side elevation that explains overall configuration of a car in an underslung elevator according to Embodiment 1 of the present invention.
Figure 2:
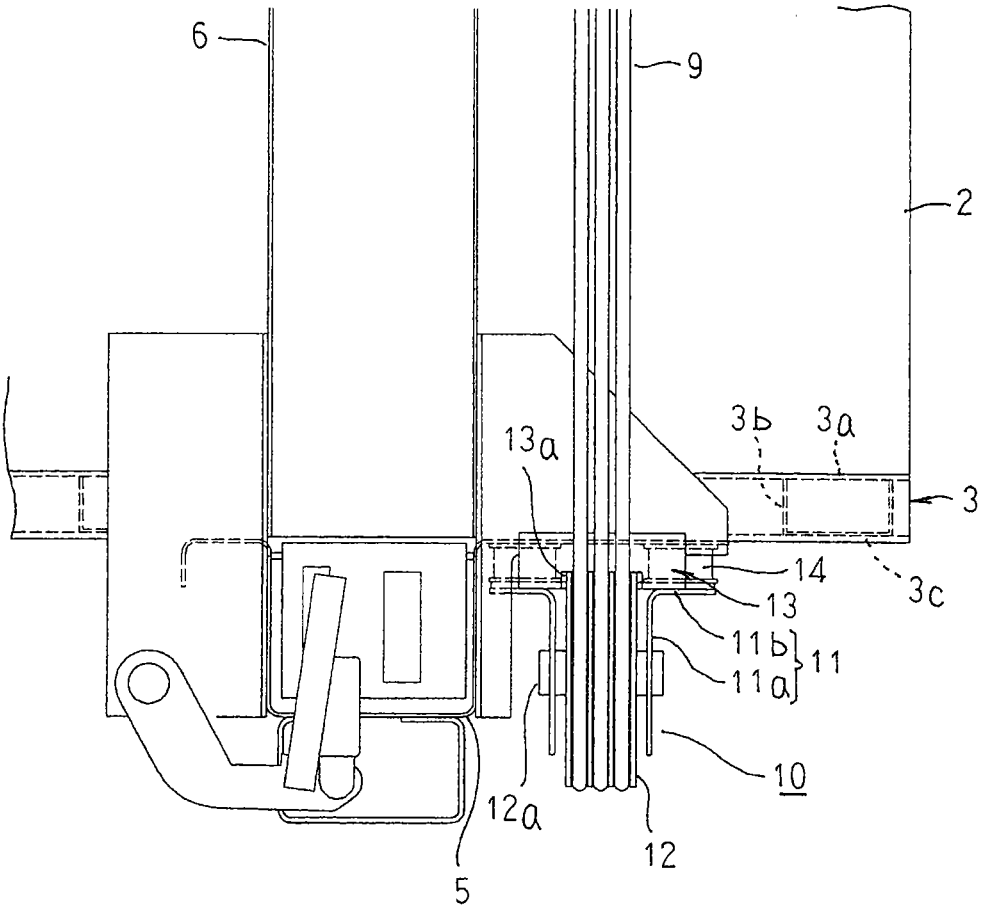
FIG. 2 is a side elevation that explains a construction for mounting a suspending sheave assembly to a lower portion of a cage in the underslung elevator according to Embodiment 1 of the present invention.
Figure 3:
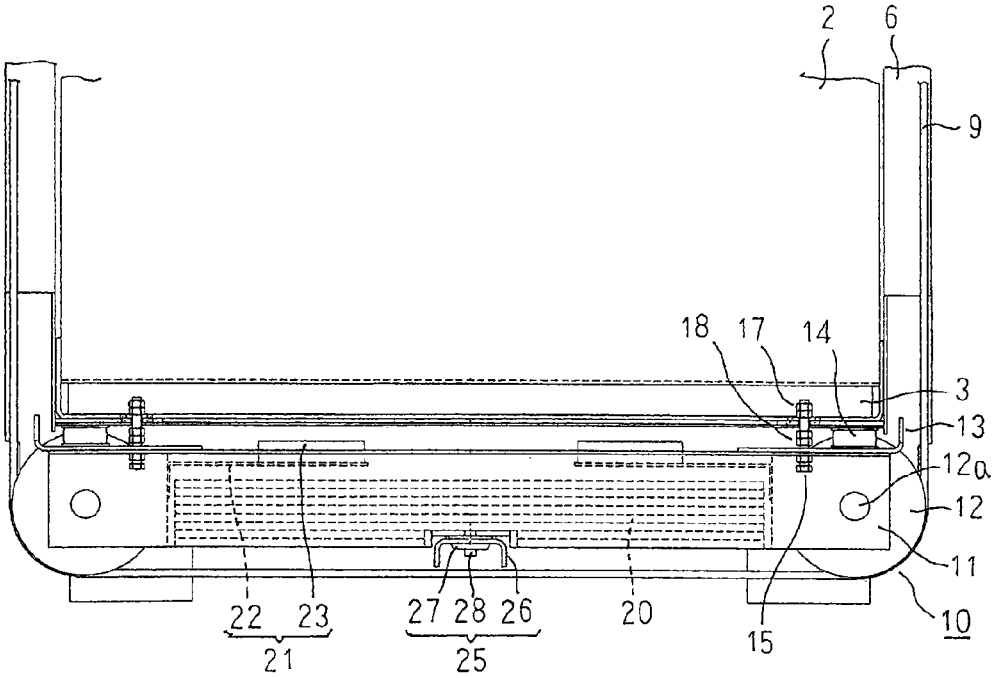
FIG. 3 is a front elevation that explains the construction for mounting the suspending sheave assembly to the lower portion of the cage in the underslung elevator according to Embodiment 1 of the present invention.
Figure 4:
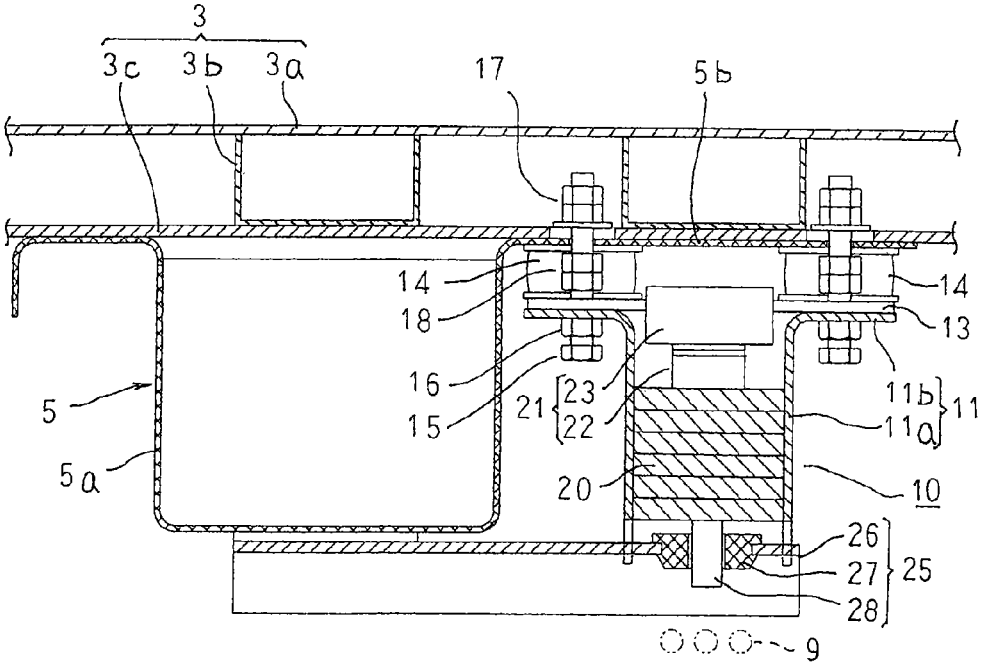
FIG. 4 is a partial cross section that explains the construction for mounting the suspending sheave assembly to the lower portion of the cage in the underslung elevator according to Embodiment 1 of the present invention.
Figure 5:
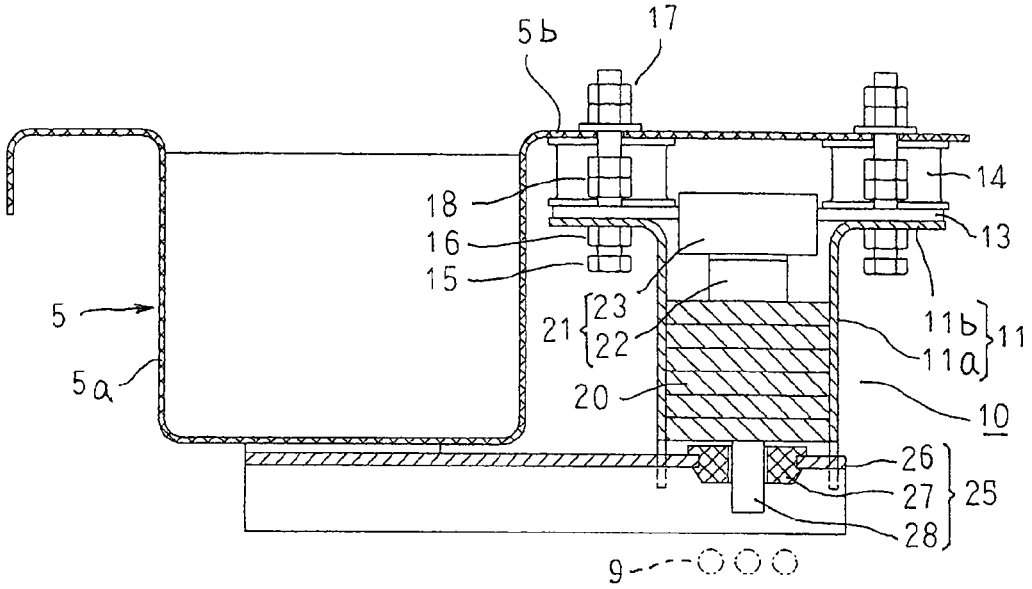
FIG. 5 is a cross section that shows the suspending sheave assembly in the underslung elevator according to Embodiment 1 of the present invention on shipment from a factory.
Figure 6:
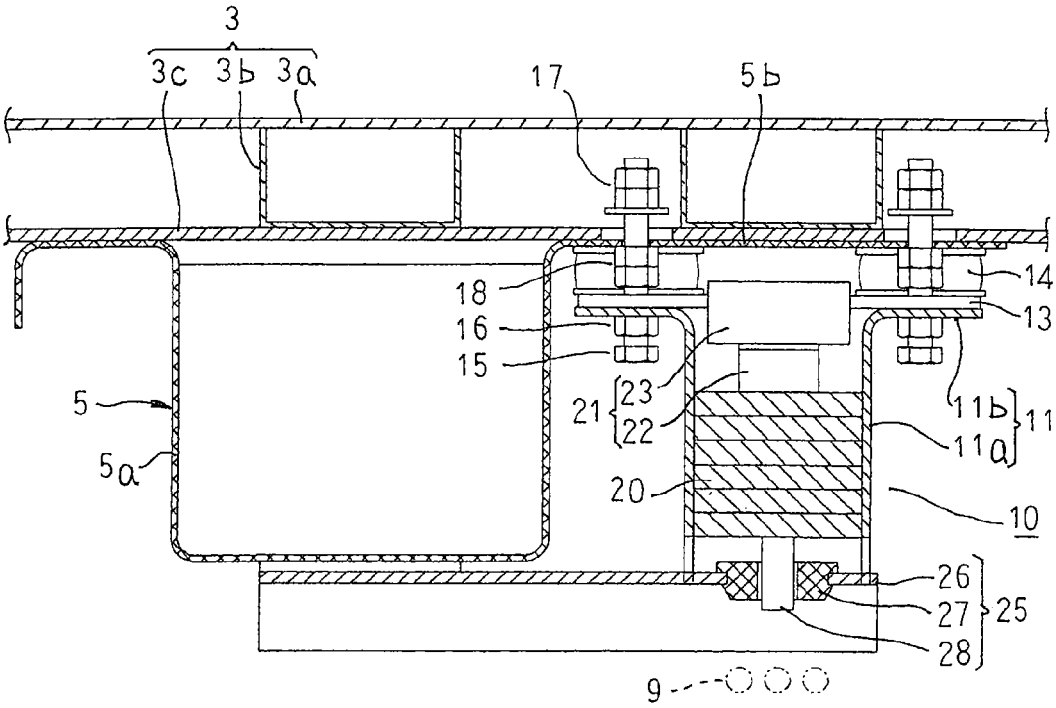
FIG. 6 is a partial cross section that shows a vicinity of the suspending sheave assembly in the underslung elevator according to Embodiment 1 of the present invention when onboard carrying capacity is exceeded.

FIG. 1 is a side elevation that explains overall configuration of a car in an underslung elevator according to Embodiment 1 of the present invention, FIG. 2 is a side elevation that explains a construction for mounting a suspending sheave assembly to a lower portion of a cage in the underslung elevator according to Embodiment 1 of the present invention, FIG. 3 is a front elevation that explains the construction for mounting the suspending sheave assembly to the lower portion of the cage in the underslung elevator according to Embodiment 1 of the present invention, FIG. 4 is a partial cross section that explains the construction for mounting the suspending sheave assembly to the lower portion of the cage in the underslung elevator according to Embodiment 1 of the present invention, FIG. 5 is a cross section that shows the suspending sheave assembly in the underslung elevator according to Embodiment 1 of the present invention on shipment from a factory, and FIG. 6 is a partial cross section that shows a vicinity of the suspending sheave assembly in the underslung elevator according to Embodiment 1 of the present invention when onboard carrying capacity is exceeded.

In FIG. 1, a car 1 in an underslung elevator includes: a cage 2; a car frame 4 that supports the cage 2; and a suspending sheave assembly 10 that is disposed on a lower portion of the cage 2.

A car floor 3 includes: a floor plate 3*a* for carrying a live load; a floor beam 3*b* that is disposed on a lower surface of the floor plate 3*a* to reinforce against flexure of the floor plate 3*a*; and a lower plate 3*c* that is disposed on an opposite side of the floor beam 3*b* so as to face the floor plate 3*a*.

The car frame 4 includes: a lower beam 5 that is disposed so as to extend in a direction of frontage directly below the cage 2, and that supports a load that acts on the car floor 3; a pair of vertical stanchions 6 that are fixed to two end portions of the lower beam 5, and that stand upright on two sides of the cage 2; and an upper beam 7 that links together upper end portions of the pair of vertical stanchions 6. Here, the lower beam 5 includes: an angular C-shaped base portion 5*a*; and flange portions 5*b* that protrude to two sides from two opening edges of the angular C shape of the base portion 5*a*, and the cage 2 is supported on the car frame 4 by the lower plate 3*c* of the car floor 3 being fixed directly to the flange portions 5*b* of the lower beam 5 by bolts, etc.

The suspending sheave assembly 10 is disposed on a lower surface of a flange portion 5*b* of the lower beam 5 in close proximity and parallel to the base portion 5*a* so as to have rubber vibration isolators 14 interposed. The car 1 is suspended by looping ropes 9 around a pair of suspending sheaves 12 so as to extend from a first end in the direction of frontage of the car 1 under the car floor 3 to a second end in the direction of frontage.

Next, configuration of the suspending sheave assembly 10 will be explained in detail based on FIGS. 2 through 6.

The suspending sheave assembly 10 includes: a pair of suspending sheave beams 11 that are each formed by bending and shaping a steel plate so as to have an L shape that includes a base portion 11*a* and a flange portion 11*b*, and that are disposed such that the flange portions 11*b* are directed outwards and the base portions 11*a* face each other; and the pair of suspending sheaves 12, which are disposed between the pair of suspending sheave beams 11 so as to protrude longitudinally outward and vertically such that respective shafts 12*a* are rotatably supported on two longitudinal end portions of the base portions 11*a* of the pair of suspending sheave beams 11. Moreover, the shafts 12*a* of the suspending sheaves 12 are perpendicular to a longitudinal direction of the lower beam 5, and are horizontal.

The pair of suspending sheave beams 11 are disposed such that the flange portions 11*b* are directed outwards and the base portions 11*a* face each other, and are configured so as to be integrated by joining to the flange portions 11*b* linking plates 13 that respectively span across the upper surfaces of two longitudinal end portions of the flange portions 11*b*. As shown in FIG. 2, longitudinally central portions of the linking plates 13 have openings, and portions of the suspending sheaves 12 protrude upward so as to pass through those opening portions 13*a*. The rubber vibration isolators 14 are disposed on the linking plates 13 on opposite sides of the portions of the suspending sheaves 12 that protrude from the opening portions 13*a*. The suspending sheave assembly 10 is disposed on a lower surface of the flange portions 5*b* of the lower beam 5 that is fixed to the lower plate 3*c* of the car floor 3 so as to have rubber vibration isolators 14 interposed such that the cage 2 is supported by the suspending sheave assembly 10 so as to isolate vibration.

Bolts 15 are screwed from below into internal screw thread portions that are formed on the flange portions 11*b*, and are fixed to the flange portions 11*b* by fastening locknuts 16 from a lower surface side. The bolts 15 pass through the linking plates 13, the flange portions 5*b* of the lower beam 5, and the lower plate 3*c* of the car floor 3 in a loosely fitted state, and protrude above the lower plate 3*c*. Moreover, apertures that are formed on the lower plate 3*c* have an aperture shape that allows passage of upper stoppers 17 (described below), and apertures that are formed on the linking plates 13 and the flange portions 5*b* have an aperture shape that allows passage of the shaft portions of the bolts 15, but that does not allow passage of the upper stoppers 17 and lower stoppers 18 (described below).

The upper stoppers 17, which are constituted by double nuts, are fixed to the bolts 15 above the lower plate 3*c*. As shown in FIG. 5, the upper stoppers 17 are positioned by the double nuts so as to contact upper surfaces of the flange portions 5*b* when the rubber vibration isolators 14 are at free length on shipment from a factory, for example. The lower stoppers 18, which are constituted by double nuts, are fixed to the bolts 15 below the flange portions 5*b*. As shown in FIG. 6, the lower stoppers 18 are positioned by the double nuts so as to contact lower surfaces of the flange portions 5*b* when the rubber vibration isolators 14 are at maximum allowable compression.

Normally, as shown in FIG. 4, the upper stoppers 17 are separated upward from the flange portions 5*b*, and the lower stoppers 18 are separated downward from the flange portions 5*b*. Thus, the compressive loads that act on the rubber vibration isolators 14 change with increases and decreases in the load on the car, and the rubber vibration isolators 14 expand and contract.

Traction countermeasure weights 20 can be mounted between the suspending sheaves 12 between the base portions 11*a* of the pair of suspending sheave beams 11.

Motion attenuators 21 are mounted to the suspending sheave assembly 10. As shown in FIG. 3, the motion attenuators 21 are constituted by two approximately L-shaped leaf springs 22 and an attenuating weight 23. The two leaf springs 22 are stacked together, and short sides ends thereof are attached to the suspending sheave assembly 10. The attenuating weight 23 is mounted above the long side ends of the two stacked two leaf springs 22. The motion attenuators 21 that are configured in this manner attenuate vibration by frictional attenuation between the two stacked two leaf springs 22, and the vibrational frequency that is attenuated can be set by changing the mounted position of the attenuating weight 23 to adjust a spring constant. The mounted position of the attenuating weight 23 can be adjusted so as to attenuate rope cogging vibration that results from rope strands, for example.

A horizontal stopper 25 is disposed on a longitudinally central lower portion of the suspending sheave assembly 10. As shown in FIG. 4, the horizontal stopper 25 includes: a mounting arm 26 that protrudes outward so as to extend from a lower surface of the lower beam 5 below the suspending sheave assembly 10; an annular elastic member 27 that is mounted into a penetrating aperture that is formed on a portion of the mounting arm 26 that is positioned below the suspending sheave assembly 10; and a cylinder member 28 that projects vertically downward from the suspending sheave assembly 10, and that passes through the elastic member 27 so as to be spaced apart from an inner circumferential wall surface of the elastic member 27.

The cylindrical member 28 of this horizontal stopper 25, which extends vertically downward from the suspending sheave assembly 10, passes through the annular elastic member 27 without contacting it. Thus, even if the load inside the car 1 increases and decreases, making the suspending sheave assembly 10 move vertically relative to the lower beam 5, the cylindrical member 28 moves vertically without contacting the elastic member 27, and does not generate a reaction force.

If an inertial load acts on the car 1 horizontally due to an earthquake, etc., then the suspending sheave assembly 10 may start to tilt because the center of gravity of the suspending sheave assembly 10 is positioned below the rubber vibration isolators 14. If the suspending sheave assembly 10 tilts, the cylindrical member 28 comes into contact with the elastic member 27, preventing the suspending sheave assembly 10 from tilting any further.

Thus, the horizontal stopper 25 allows vertical movement of the suspending sheave assembly 10, and acts to restrict horizontal movement, controlling tilting of the suspending sheave assembly 10 so as not to exceed a set tilting.

In Embodiment 1, because the rubber vibration isolators 14 are positioned vertically above the shafts 12*a* of the suspending sheaves 12 when viewed from an axial direction of the shafts 12*a*, positions at which the load that is suspended by the ropes 9 acts on the suspending sheave beams 11 through the shafts 12*a* of the suspending sheaves 12, and positions at which the suspending sheave beams 11 are supported on the lower surface of the car floor 3 (positions of the rubber vibration isolators 14) are aligned. Thus, the suspended load acts on the rubber vibration isolators 14 from vertically below, and bending moments that result from the suspended load do not act on the suspending sheave beams 11. Thus, it is not necessary to increase the rigidity of the suspending sheave beams 11 excessively by increasing the thickness of the suspending sheave beams 11, or by increasing the height thereof, enabling reductions in cost and reductions in weight of the suspending sheave assembly 10 to be achieved.

The suspending sheaves 12 are mounted to the pair of suspending sheave beams 11 such that portions thereof protrude upward beyond the pair of suspending sheave beams 11, and the rubber vibration isolators 14 are disposed so as to be positioned on opposite sides of the suspending sheaves 12 when viewed from vertically above. Thus, because a protruding height of the suspending sheave assembly 10 from the lower surface of the car floor 3 can be reduced, the suspending sheave assembly 10 does not protrude below the lowermost end on the lower beam 5 side, enabling pit depth to be reduced, thereby enabling space saving to be achieved.

The bolts 15 are screwed from below into internal screw thread portions that are formed on the flange portions 11*b*, and are fixed to the flange portions 11*b* by fastening the locknuts 16 from a lower surface side. The bolts 15 pass through the linking plates 13, the flange portions 5*b* of the lower beam 5, and the lower plate 3*c* of the car floor 3 in a loosely fitted state, and protrude above the lower plate 3*c*. In addition, the lower stoppers 18, which are constituted by double nuts, are fixed to the bolts 15 below the flange portions 5*b*. As shown in FIG. 6, the lower stoppers 18 are positioned by the double nuts so as to contact lower surfaces of the flange portions 5*b* when the rubber vibration isolators 14 are at maximum allowable compression.

During emergencies, for example, if the car 1 is pushed up, and rope tension is relaxed momentarily, then an impulsive load acts due to deadweight of the car 1, and the cage 2 moves downward, compressing the rubber vibration isolators 14. This impulsive load is large, and there is a risk that the rubber vibration isolators 14 may be compressed beyond maximum allowable compression. However, as shown in FIG. 6, if the distance between the car floor 3 and the linking plates 13 (the flange portions 11*b*) of the suspending sheave assembly 10 becomes narrower, the lower stoppers 18 come into contact with the flange portions 5*b*, preventing further downward movement of the cage 2. Thus, situations such as the rubber vibration isolators 14 being damaged by being compressed beyond maximum allowable compression can be avoided.

The upper stoppers 17, which are constituted by double nuts, are fixed to the bolts 15 above the lower plate 3*c*. As shown in FIG. 5, the upper stoppers 17 are positioned by the double nuts so as to contact upper surfaces of the flange portions 5*b* when the rubber vibration isolators 14 are at free length.

Thus, in cases in which rope tension is loosened such as during installation and maintenance, or when the ropes are replaced, the upper stoppers 17 come into contact with the flange portions 5*b*, preventing tensile loads from acting on the rubber vibration isolators 14. Thus, situations such as the rubber vibration isolators 14 being damaged by being extended excessively can be avoided.

Here, because the upper stoppers 17 are positioned such that the upper stoppers 17 contact upper surfaces of the flange portions 5*b* when the rubber vibration isolators 14 are at free length, the suspending sheave assembly 10 is attached integrally to the lower beam 5, as shown in FIG. 5. Thus, if the upper stoppers 17 are positioned on factory shipment such that the upper stoppers 17 come into contact with the flange portions 5*b* when the rubber vibration isolators 14 are at free length, situations such as the rubber vibration isolators 14 being damaged by being extended excessively can be avoided during transportation from the factory to the installation site. Furthermore, at the installation site, the suspending sheave assembly 10 can be installed on the lower portion of the car floor 3 simply by placing the car floor 3 on the lower beam 5 such that the upper stoppers 17 are passed through the penetrating apertures that are formed on the lower plate 3*c*, and fixing the flange portions 5*b* to the lower plate 3*c* by bolts, etc., improving installation workability of the elevator. In addition, on-site position adjustment of the upper stoppers 17 is no longer required, enabling installation workability of the elevator to be further improved.

The upper stoppers 17 and the lower stoppers 18 are configured coaxially, that is, configured using double nuts that are screwed onto single bolts 15, enabling upper stoppers 17 and the lower stoppers 18 to be achieved by a simple construction.

Because the pair of suspending sheave beams 11 are disposed so as to face each other so as to be separated, a vacant space is formed between the suspending sheaves 12. Thus, if required, it is possible to dispose traction countermeasure weights 20 in the vacant space between the pair of suspending sheave beams 11. For example, in an elevator in which the load on the car is large, if the car frame 4 is light when operating without a load, then rope tension that acts on a sheave of a hoisting machine is small, and because traction between the ropes 9 and the sheave is insufficient, it is difficult to hold the unbalanced load of the car 1 and the counterweight. Thus, it has been necessary to ensure traction capacity by loading the lower beam 5 of the car frame 4 and the counterweight with supplementary weights.

In the construction of the present car 1, if supplementary weights are loaded in the lower beam 5 of the car frame 4, then a compressive load that acts on the rubber vibration isolators 14 is increased in proportion to the supplementary weights, giving rise to cases in which the allowable compressive load of the rubber vibration isolators 14 may be exceeded. In such cases, countermeasures are required such as increasing the allowable compressive load of the rubber vibration isolators 14, or increasing the number of rubber vibration isolators 14, giving rise to cost increases. In Embodiment 1, because the weights 20 are disposed between the pair of suspending sheave beams 11, the load of the weights 20 does not act on the rubber vibration isolators 14 as a compressive load. Consequently, countermeasures such as increasing the allowable compressive load of the rubber vibration isolators 14, or increasing the number of rubber vibration isolators 14, are no longer required, enabling cost increases to be suppressed.

Because the motion attenuators 21 are mounted to the suspending sheave assembly 10, specific vibrations such as rope cogging vibration that results from the rope strands can be attenuated, enabling riding comfort to be improved.

Because the horizontal stopper 25, which allows vertical movement of the suspending sheave assembly 10 and stops horizontal movement, is included, tilting of the suspending sheave assembly 10 will be suppressed even if an earthquake occurs, achieving higher safety.

Moreover, in Embodiment 1 above, the rubber vibration isolators 14 are disposed between the flange portions 5*b* of the lower beam 5 and the suspending sheave assembly 10, but the rubber vibration isolators 14 may alternatively be disposed between the lower plate 3*c* of the car floor 3 and the suspending sheave assembly 10. In that case, penetrating apertures for the passage of the bolts 15 that are formed on the lower plate 3*c* will be formed so as to be larger in diameter than the shaft portions of the bolts 15, and so as to be smaller in diameter than the upper stoppers 17.

Embodiment 2

Figure 7:
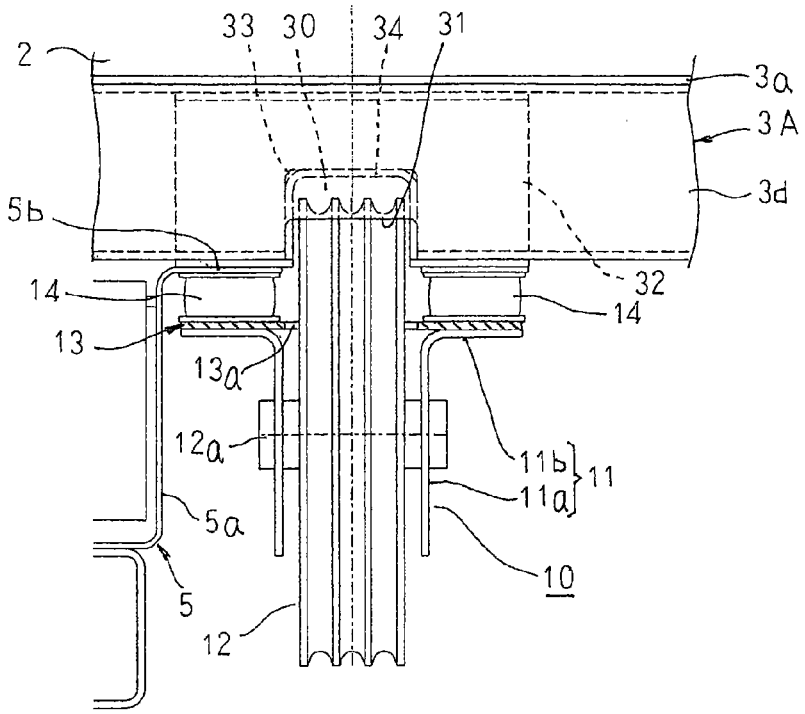
FIG. 7 is a partial side elevation that shows a vicinity of a suspending sheave assembly in an underslung elevator according to Embodiment 2 of the present invention.
Figure 8:
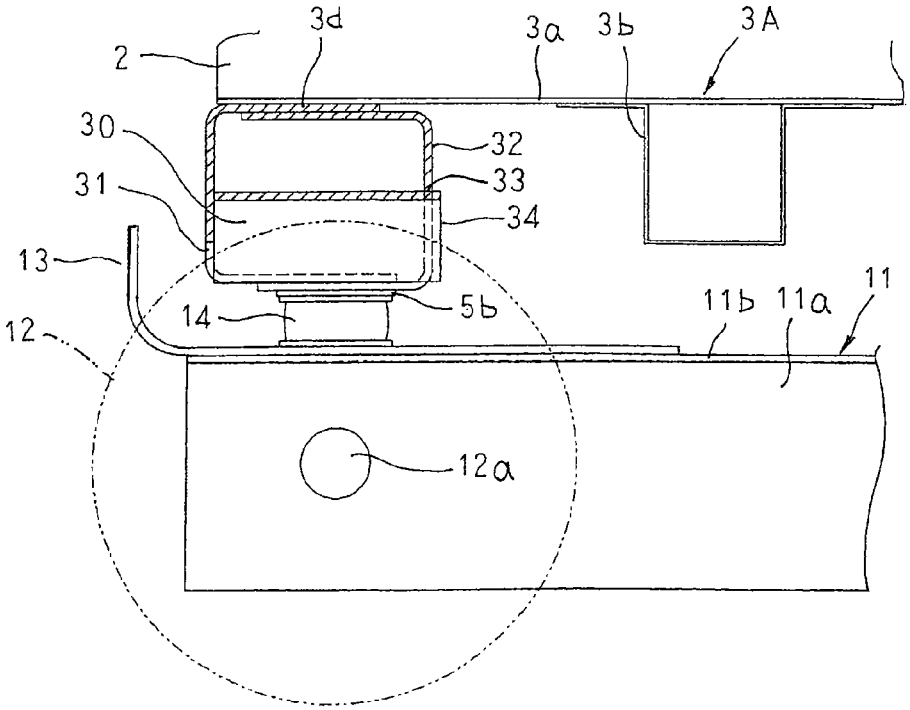
FIG. 8 is a partial front elevation that shows the vicinity of the suspending sheave assembly in the underslung elevator according to Embodiment 2 of the present invention.

FIG. 7 is a partial side elevation that shows a vicinity of a suspending sheave assembly in an underslung elevator according to Embodiment 2 of the present invention, and FIG. 8 is a partial front elevation that shows the vicinity of the suspending sheave assembly in the underslung elevator according to Embodiment 2 of the present invention. Moreover, for simplicity, the suspending sheaves are represented by double-dotted chain lines in FIG. 8.

In FIGS. 7 and 8, a car floor 3A includes: a floor plate 3*a* for carrying a live load; a floor beam 3*b* that is disposed on a lower surface of the floor plate 3*a* to reinforce against flexure of the floor plate 3*a*; and floor frame side beams 3*d* that are mounted to lower surfaces of two side portions of the floor plate 3*a* in a direction of frontage. Moreover, the side portions of the floor plate 3*a* in the direction of frontage are side portions of the floor plate 3*a* that face car guide rails (not shown).

The floor frame side beams 3*d* are produced so as to have an angular C-shaped cross-sectional shape, and are mounted to a lower surface of the floor plate 3*a* such that openings of the angular C shape face toward a center of a cage 2. Suspending sheave housing portions 30 are formed by cutting away portions in a vicinity of a lower portion of a main portion that is positioned on an opposite side from the opening of the angular C shape and on a lower side portion of the floor frame side beams 3*d*. Load supporting members 32 are produced so as to have an angular C-shaped cross-sectional shape that is similar or identical to that of the floor frame side beams 3*d*, and notch portions 33 are formed by cutting away portions in a vicinity of a lower portion of a main portion of the angular C shape and on a lower side portion of the load supporting members 32. The load supporting members 32 are fitted together with the floor frame side beams 3*d* such that the main portions of the angular C shape face toward the center of the cage 2 so as to align the notch portions 33 thereof with the notches 31 that are formed on the floor frame side beams 3*d*. The floor frame side beams 3*d* and the load supporting members 32 are joined together by welding, etc., such that the upper side portions contact each other and the lower side portions contact each other. In addition, angular C-shaped reinforcing members 34 are inserted through the notch portions 33 such that the openings of the angular C shapes face downward, and are joined together with the floor frame side beams 3*d* and the load supporting members 32 by welding, etc.

Thus, the upper portions of the suspending sheave housing portions 30 are configured so as to have a "closed-section construction" in which the cross section is closed by the floor frame side beam 3*d*, the load supporting member 32, and the reinforcing member 34 to form a box.

The cage 2 is supported on the car frame 4 by the lower side portions of the floor frame side beams 3*d* of the car floor 3A being fixed directly to the flange portions 5*b* of the lower beam 5 by bolts, etc.

Rubber vibration isolators 14 are disposed on the linking plates 13 on opposite sides of the portions of the suspending sheaves 12 that protrude from the opening portions 13*a*. A suspending sheave assembly 10 is disposed on a lower surface of the flange portions 5*b* of the lower beam 5 that is fixed to the floor frame side beams 3*d* of the car floor 3A so as to have rubber vibration isolators 14 interposed such that the cage 2 is supported by the suspending sheave assembly 10 so as to isolate vibration.

The suspending sheave assembly 10 is disposed on a lower surface of a flange portion 5*b* of the lower beam 5 in close proximity and parallel to the base portion 5*a* so as to have the rubber vibration isolators 14 interposed. Portions of the suspending sheaves 12 that protrude from the opening portions 13*a* are housed inside the suspending sheave housing portions 30. The car 1 is suspended by looping ropes 9 around the pair of suspending sheaves 12 so as to extend from a first end in the direction of frontage of the car 1 under the car floor 3A to a second end in the direction of frontage.

Although not shown, bolts 15 are screwed from below into internal screw thread portions that are formed on the flange portions 11*b*, and are fixed to the flange portions 11*b* by fastening the locknuts 16 from a lower surface side. The bolts 15 pass through the linking plates 13, the flange portions 5*b* of the lower beam 5, and lower side portions of the floor frame side beams 3*d* of the car floor 3A in a loosely fitted state, and protrude into the floor frame side beams 3*d*. The upper stoppers 17 are fixed to the bolts 15 above the lower side portions of the floor frame side beams 3*d*. The lower stoppers 18 are fixed to the bolts 15 below the flange portions 5*b*.

Moreover, the rest of the configuration is formed in a similar or identical manner to that of Embodiment 1 above.

In Embodiment 2, because the rubber vibration isolators 14 are positioned vertically above the shafts 12*a* of the suspending sheaves 12 when viewed from an axial direction of the shafts 12*a*, positions at which a load that is suspended by the ropes 9 acts on the suspending sheave beams 11 through the shafts 12*a* of the suspending sheaves 12, and positions at which the suspending sheave beams 11 are supported on the lower surface of the car floor 3A (positions of the rubber vibration isolators 14) are aligned. Thus, bending moments that result from the suspended load do not act on the suspending sheave beams 11. Thus, it is not necessary to increase the rigidity of the suspending sheave beams 11 excessively by increasing the thickness of the suspending sheave beams 11, or by increasing the height thereof, enabling reductions in cost and reductions in weight of the suspending sheave assembly 10 to be achieved.

Portions of the suspending sheaves 12 protrude upward beyond the pair of suspending sheave beams 11, and are housed in the suspending sheave housing portions 30 that are formed on the car floor 3A, and the rubber vibration isolators 14 are disposed so as to be positioned on opposite sides of the suspending sheaves 12 when viewed from vertically above. Thus, a protruding height of the suspending sheaves 12 from the lower surface of the car floor 3A can be reduced. Pit depth can be reduced thereby, enabling space saving to be achieved.

The suspending sheave housing portions 30 are formed by cutting away portions of the floor frame side beams 3*d*, but because the upper portions of the suspending sheave housing portions 30 have a closed-section construction, reductions in rigidity and strength that result from forming the notches 31 on the floor frame side beams 3*d* can be compensated for.

Moreover, in Embodiment 2 above, the rubber vibration isolators 14 are disposed between the flange portions 5*b* of the lower beam 5 and the suspending sheave assembly 10, but the rubber vibration isolators 14 may alternatively be disposed between the floor frame side beams 3*d* of the car floor 3A and the suspending sheave assembly 10. In that case, penetrating apertures for the passage of the bolts 15 that are formed on the lower side portions of the floor frame side beams 3*d* will be formed so as to be larger in diameter than the shaft portions of the bolts 15, and so as to be smaller in diameter than the upper stoppers 17.

Moreover, in Embodiments 1 and 2 above, the pair of suspending sheave beams 11 are configured into a single body by linking the flange portions 11*b* using the linking plates 13, but the linking plates 13 may be omitted. In that case, the rubber vibration isolators 14 will be disposed on the flange portions 11*b* of the pair of suspending sheave beams 11 on opposite sides of the protruding portions of the suspending sheaves 12, and the suspending sheave assembly 10 will be disposed on the lower surfaces of the flange portions 5*b* of the lower beams 5 that are fixed to the lower plate 3*c* of the car floor 3 so as to have the rubber vibration isolators 14 interposed.

The invention claimed is:

1. An underslung elevator comprising:

a cage;

a car frame lower beam that is fixed directly to a lower surface of a car floor of said cage, and that supports said cage;

a suspending sheave assembly that is disposed on a lower portion of said car floor, said suspending sheave assembly including:

a pair of suspending sheave beams that are disposed so as to face each other so as to be separated; and a pair of suspending sheaves that are each supported rotatably between two longitudinal end portions of said pair of suspending sheave beams; and rubber vibration isolators that are disposed between said car floor and said suspending sheave assembly, or between said car frame lower beam and said suspending sheave assembly, wherein:

said pair of suspending sheaves are supported on said pair of suspending sheave beams such that portions thereof protrude upward beyond said pair of suspending sheave beams; and said rubber vibration isolators are disposed so as to be positioned vertically above shafts of said suspending sheaves when viewed from an axial direction of each of said pair of suspending sheaves, and so as to be positioned on opposite sides of each of said pair of suspending sheaves when viewed from vertically above; and wherein said car floor comprises: a floor plate on which a load is placed; a floor beam that is mounted to a lower surface of said floor plate so as to reinforce against flexure of said floor plate; and floor frame side beams that are mounted to lower surfaces of two side portions of said floor plate in a direction of frontage, and to which said car frame lower beam is fixed; suspending sheave housing portions are formed by cutting away a portion of lower portion sides of said floor frame side beams; and said suspending sheave assembly is disposed on a lower portion of said floor frame side beam so as to house inside said suspending sheave housing portions said portions of said pair of suspending sheaves that protrude upward beyond said pair of suspending sheave beams.

2. The underslung elevator according to claim 1, wherein an upper portion of said suspending sheave housing portions of said floor frame side beams is configured so as to have a closed-section construction.

3. The underslung elevator according to claim 1, wherein said suspending sheave assembly is disposed so as to be parallel to said car frame lower beam.

4. The underslung elevator according to claim 1, wherein a traction countermeasure weight is disposed between said pair of suspending sheaves so as to be between said pair of suspending sheave beams.

5. The underslung elevator according to claim 1, wherein a motion attenuator is disposed on said suspending sheave assembly.

6. The underslung elevator according to claim 1, further comprising a lower stopper for preventing damage to said rubber vibration isolators due to compression, that stops approach of said car floor toward said suspending sheave assembly such that a distance between said car floor and said suspending sheave assembly does not become less than or equal to a first set value.

7. The underslung elevator according to claim 1, further comprising an upper stopper for preventing damage to said rubber vibration isolators due to extension, that stops separation of said car floor from said suspending sheave assembly such that a distance between said car floor and said suspending sheave assembly does not become greater than or equal to a second set value.

8. The underslung elevator according to claim 7, wherein said upper stopper, said rubber vibration isolators, and said suspending sheave assembly are attached integrally to said car floor or to said car frame lower beam.

9. The underslung elevator according to claim 1, further comprising:

a lower stopper for preventing damage to said rubber vibration isolators due to compression, that stops approach of said car floor toward said suspending sheave assembly such that a distance between said car floor and said suspending sheave assembly does not become less than or equal to a first set value; and an upper stopper for preventing damage to said rubber vibration isolators due to extension, that stops separation of said car floor from said suspending sheave assembly such that a distance between said car floor and said suspending sheave assembly does not become greater than or equal to a second set value that is greater than said first set value.

10. The underslung elevator according to claim 9, wherein said lower stopper and said upper stopper are configured coaxially.

11. The underslung elevator according to claim 1, further comprising a horizontal stopper that restricts horizontal movement of said suspending sheave assembly, and allows vertical movement thereof.

12. The underslung elevator according to claim 11, wherein said horizontal stopper comprises:

a mounting arm that is disposed so as to extend below said suspending sheave assembly from said car frame lower beam or from said car floor;

an annular elastic member that is mounted to a penetrating aperture that is formed on a portion of said mounting arm that is positioned below said suspending sheave assembly; and a cylindrical member that is fixed to said suspending sheave assembly, and that extends vertically downward so as to pass through said elastic member so as to be spaced apart from an inner circumferential wall surface of said elastic member.

* * * * *